United States Patent [19]

Scinta

[11] Patent Number: 4,909,928

[45] Date of Patent: Mar. 20, 1990

[54] COATING OF SOLID CARBONACEOUS MATERIAL WITH HYDROCARBON LIQUID IN PROCESS UTILIZING WATER CONTAINING SYSTEM FOR RECEIVING SUCH CARBONACEOUS MATERIAL THERETHROUGH

[75] Inventor: James Scinta, Houston, Tex.

[73] Assignee: Phillips Petroleum Company, Bartlesville, Okla.

[21] Appl. No.: 196,902

[22] Filed: May 20, 1988

[51] Int. Cl.[4] ..... C10G 11/02

[52] U.S. Cl. ..... 208/415; 208/428; 208/435; 208/414; 208/391

[58] Field of Search ..... 208/415, 417, 426, 428, 208/430, 435, 952, 414, 391

[56] References Cited

U.S. PATENT DOCUMENTS

| | | | |
|---|---|---|---|
| 2,609,331 | 9/1952 | Cheney | 208/430 X |
| 3,041,267 | 6/1962 | Frame et al. | 208/435 X |
| 3,617,471 | 11/1971 | Schlinger | 208/414 |
| 3,617,472 | 11/1971 | Schlinger | 208/414 |
| 3,715,301 | 2/1973 | Tassoney et al. | 208/414 X |
| 3,729,105 | 7/1973 | Huebler et al. | 214/17 B |
| 3,748,254 | 7/1973 | Gorin | 208/426 X |
| 3,929,625 | 12/1975 | Lucas | 208/188 |
| 3,960,702 | 6/1976 | Allred | 208/952 X |
| 4,057,399 | 11/1977 | Cole et al. | 44/6 |
| 4,247,240 | 1/1981 | Schora, Jr. et al. | 414/218 |
| 4,332,593 | 6/1982 | Burgess et al. | 44/51 |
| 4,358,293 | 11/1982 | Mark | 44/51 |
| 4,401,402 | 8/1983 | Casperson | 414/218 |
| 4,406,664 | 9/1983 | Burgess et al. | 44/51 |
| 4,410,415 | 10/1983 | Seltzer | 208/11 |
| 4,412,843 | 11/1983 | Burgess et al. | 44/51 |
| 4,455,148 | 6/1984 | Nagata et al. | 44/15 R |
| 4,528,090 | 7/1985 | Tsui | 208/426 X |
| 4,576,708 | 3/1986 | Oko et al. | 208/430 X |
| 4,673,133 | 6/1987 | Datta et al. | 241/19 |

FOREIGN PATENT DOCUMENTS

| | | | |
|---|---|---|---|
| 408282 | 9/1950 | Canada | 208/426 |
| 0067784 | 4/1983 | Japan | 208/435 |

OTHER PUBLICATIONS

*Kirk-Othmer Encyclopedia of Chemical Technology*, third ed., vol. 16, New York, John Wiley & Sons, 1981, pp. 342-344.

*Kirk-Othmer Encyclopedia of Chemical Technology*, third ed., vol. 22, New York, John Wiley & Sons, 1983, pp. 531-532.

*Primary Examiner*—Glenn Caldarola

*Attorney, Agent, or Firm*—William R. Sharp

[57] ABSTRACT

A process is provided wherein a carbonaceous material, such as oil shale, is coated with a hydrocarbon liquid, such as shale oil, prior to introduction of the carbonaceous material to a water containing, sealed system, through which the carbonaceous material is transferred to a high pressure vessel, i.e. a retort. The liquid hydrocarbon coating on the carbonaceous material effectively minimizes water absorption by the carbonaceous material in its passage through the water containing system.

12 Claims, 1 Drawing Sheet

COATING OF SOLID CARBONACEOUS MATERIAL WITH HYDROCARBON LIQUID IN PROCESS UTILIZING WATER CONTAINING SYSTEM FOR RECEIVING SUCH CARBONACEOUS MATERIAL THERETHROUGH

BACKGROUND OF THE INVENTION

The present invention relates to a process wherein a solid carbonaceous material is coated with a hydrocarbon liquid prior to transference of such coated carbonaceous material to a water containing system. The invention is particularly applicable to oil shale and shale oil as the carbonaceous material and hydrocarbon liquid, respectively.

It is known in the prior art to use water containing, sealed systems, such as lock hopper systems and water sealed pump systems, to transfer oil shale from a low pressure zone, such as from a feed hopper, to a high pressure zone, such as a retort. Although using such water containing systems to transfer carbonaceous materials, such as oil shale, to a high pressure zone has been found to be effective, further improvement would be desirable.

SUMMARY OF THE INVENTION

It is, therefore, an object of the invention to provide an improved process for transferring carbonaceous material through a water containing system to a high pressure zone.

The above object is realized by a process which comprises: contacting a quantity of a solid carbonaceous material with a liquid hydrocarbon, employing a hydrocarbon liquid to solid carbonaceous material weight ratio of about 1/50 to about 1/500, so as to form a coating of hydrocarbon liquid on the carbonaceous material; introducing the thus coated carbonaceous material to a water containing system; and transferring the carbonaceous material through and from the water containing system to a high pressure vessel, such as, for example, a retort.

By coating the carbonaceous material with hydrocarbon liquid, water absorption by the carbonaceous material while in the water containing system is significantly reduced so as to improve the efficiency of subsequent processing of the carbonaceous material, such as in a retort.

DETAILED DESCRIPTION OF THE INVENTION

Figure 1:
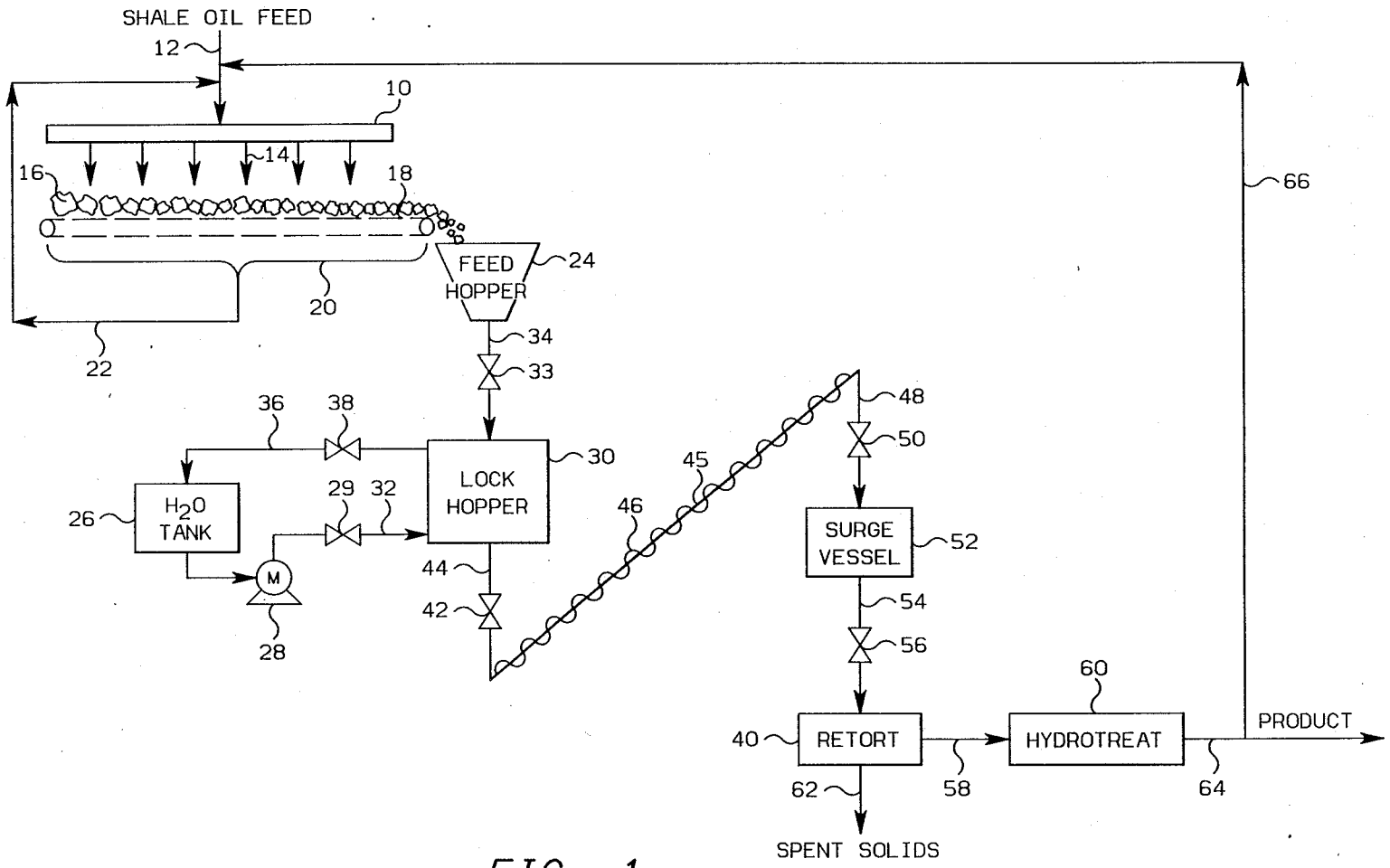
FIG. 1 is a schematic illustration of one embodiment of the invention as applied to a retorting operation.

An embodiment of the invention will now be described in detail with reference to the drawing. This embodiment utilizes oil shale, and shale oil for coating the oil shale, and further employs a water sealed lock hopper system through and by means of which coated carbonaceous material is transferred to a retort for retorting thereof. It should be understood, however, that the invention is applicable to other hydrocarbon liquids and other carbonaceous materials such as coal, which can be fed to a gasifier, and that the invention is applicable to other water sealed systems such as water sealed pump systems.

Referring to FIG. 1, the illustrated embodiment of the invention includes a spray bar, or sprayer, 10 which receives a supply of fresh shale oil feed via line 12. The spray bar accordingly sprays shale oil, as indicated by the arrows at 14, onto chunks of oil shale 16 which are supported upon a movable and preferably perforated belt 18. Consequently, the oil shale 16 is coated with the shale oil. Excess shale oil drips by gravity through perforations in the belt 18 and is collected by an appropriate collection means as is schematically indicated at 20. The thus collected shale oil is then recycled back to the spray bar 10 via line 22. Such recycling of collected shale oil assists in the optimization of the economy of the process.

Of course, alternative techniques for coating the oil shale with shale oil are within the scope of certain aspects of the invention. For example, the oil shale could be sprayed with shale oil after the oil shale is dumped into feed hopper 24. In any event, the oil shale is contacted with no liquid other than the shale oil before being introduced to the lock hopper, later discussed in more detail.

It is preferred that a shale oil to oil shale weight ratio in the range of about 1/50 to about 1/500, and most preferably in the range of about 1/150 to about 1/300, be employed in the contacting of the oil shale with shale oil. In other words, where a quantity of shale oil having a weight $W_1$ is contacted with a quantity of oil shale having a weight $W_2$, the ratio $W_1/W_2$ is preferably in the ranges specified above. This ratio can be calculated in the illustrated embodiment by determining the weight of the oil shale which passes under the spray from spray bar 10 in a predetermined period of time and the weight of the shale oil sprayed by spray bar 10 in such a period of time, and then dividing the so obtained oil shale weight into the shale oil weight to obtain the ratio. Only enough shale oil is needed to place a thin coating on the oil shale.

With respect to conditions which are maintained during contacting of the oil shale with the shale oil, it is preferred that such contacting take place at ambient temperature, most preferably at a temperature in the range of about 70° F. to about 80°F., and at atmospheric pressure.

In the subsequent description, all valves are assumed to be closed unless stated otherwise.

The coated oil shale 16 is carried by belt 18 to a position adjacent the top of feed hopper 24, at which point the coated shale is dropped into feed hopper 24. The particle sizes of the oil shale fed to the feed hopper 24 can vary depending upon the economical advantages sought. The finer size particles are desired due to their ease of using such particles in a lock hopper. However, reducing the size of the oil shale particles can be expensive and time consuming. Thus, economics can have a direct bearing on the particular size range of oil shale employed. Preferably, the oil shale used has an average particle size between ⅛inches and 2 inches.

Water in tank 26 is now pumped therefrom by means of pump 28 through open valve 29 into lock hopper 30 via line 32 so as to only partially fill the lock hopper. Valve 33 is opened to allow the coated shale to flow into lock hopper 30 via line 34 so as to at least partially fill the lock hopper. Overflow water is allowed to flow into tank 26 through line 36 and open valve 38.

Valves 33 and 38 are closed, after which more water is pumped into lock hopper 30 until the interior of the lock hopper is pressurized to a pressure approximately equivalent to the pressure in retort 40. Valve 42 is now opened to allow the contents of lock hopper 30 to flow into and through line 44 so as to enter the lower end of an upwardly extending circuit 45. Conduit 45 contains a screw conveyor which is schematically indicated at 46.

The water level in conduit 45 is preferably maintained at a level intermediate the lower and upper ends of conduit 45. Maintenance of such a water level provides an effective liquid seal between retort 40 and lock hopper 30 which inhibits gas flow from retort 40 to lock hopper 30. Rotation of screw conveyor 46 by an appropriate motor (not shown) causes the individual chunks of oil shale to be conveyed through conduit 45 to its upper end. The oil shale is then dropped through line 48 and open valve 50 into surge vessel 52. Oil shale is allowed to enter retort 40 via line 54 by opening valve 56. Surge vessel 52 and valve 56 can be utilized to control the amount of shale discharged into retort 40.

The oil shale is retorted in retort 40 to thereby produce a liquid hydrocarbon product which is passed through line 58 to additional processing equipment such as the hydrotreating system 60 shown in the illustrated embodiment. Spent solids are discharged through line 62. Final shale oil product is discharged from hydrotreating system 60 through line 64. At least a portion of this shale oil product is preferably passed to spray bar 10 via line 66 for spraying onto fresh oil shale.

An example will now be described which demonstrates the effectiveness of a coating of shale oil on oil shale in minimizing the absorption of water by the oil shale. All tests hereinafter described employed Eastern oil shale with particles in the size range of about ½inch to about ¾ inch.

Three separate tests were performed in which dry oil shale, without a shale oil coating, was immersed in and subsequently withdrawn from a quantity of water to thereby result in water wet shale. The dry shale and water wet shale were weighed to determine the amount of water absorbed by the shale. Data in regard to these tests is given in Table 1. Weight measurements are expressed in units of grams. t,--6-

A test was then performed in which dry oil shale was first coated with Eastern shale oil (fraction having a boiling point below 650° F.). The oil coated shale was then immersed in water for about the same period of time the dry shale was immersed in Tests 1, 2 and 3. Shale oil was applied to the shale by dropper at room temperature (about 75° F.) and atmospheric pressure conditions using a shale oil to oil shale weight ratio of about 1/225. Virtually all of the shale oil was absorbed by the shale. Data in regard to this test is given in Table 2. Weight measurements are again expressed in grams. t,0070

A comparison of the amounts (in weight) of water absorbed by the oil shale in Tables 1 and 2 clearly indicates that oil shale coated with shale oil exhibits excellent properties for minimizing water absorption.

Thus, there is provided by the present invention a process utilizing a water containing and sealed system wherein a carbonaceous material (i.e. oil shale) is coated with liquid hydrocarbon (i.e. shale oil) prior to introduction of the carbonaceous material to the water containing system so as to minimize absorption of water by the carbonaceous material.

Obviously, many modifications and variations of the present invention are possible in light of the above teachings.

That which is claimed is:

1. A process comprising:

(a) contacting a quantity of a solid carbonaceous material with a hydrocarbon liquid, wherein the weight ratio of hydrocarbon liquid to solid carbonaceous material corresponding to the hydrocarbon liquid contacted with the quantity of solid carbonaceous material in said contacting step is in the range of about 1/50 to about 1/500 so as to form a coating of hydrocarbon liquid on said quantity of solid carbonaceous material which serves to minimize absorption of water by the solid carbonaceous material;

(b) introducing the thus coated quantity of solid carbonaceous material to a water containing system;

(c) transferring said quantity of solid carbonaceous material through and from said water containing system to a high pressure vessel.

2. A process as recited in claim 1 wherein said weight ratio is in the range of about 1/150 to about 1/300.

3. A process as recited in claim 1 wherein said quantity of solid carbonaceous material is contacted with no liquid other than said hydrocarbon liquid before step (b).

4. A process as recited in claim 2, wherein said solid carbonaceous material is oil shale and said hydrocarbon liquid is shale oil.

5. A process as recited in claim 4 wherein step (a) is carried out at a temperature of about 70° F. to about 80° F.

6. A process as recited in claim 5 wherein step (a) is carried out at atmospheric pressure.

7. A process as recited in claim 1 wherein step (a) comprises spraying said quantity of solid carbonaceous material with said hydrocarbon liquid.

8. A process as recited in claim 7 wherein said high pressure vessel comprises a retort.

9. A process comprising:

(a) contacting a quantity of a solid carbonaceous material with a hydrocarbon liquid, employing a hydrocarbon liquid to solid carbonaceous material weight ratio of in the range of about 1/50 to about 1/500, so as to form a coating of hydrocarbon liquid on said quantity of solid carbonaceous material which serves to minimize absorption of water by the solid carbonaceous material;

(b) introducing the the thus coated quantity of solid carbonaceous material to a water containing system, wherein said water containing system includes a lock hopper;

(c) transferring said quantity of solid carbonaceous material through and from said water containing system to a high pressure vessel.

10. A process as recited in claim 9 further comprising pressurizing the interior of said lock hopper with water after step (b) but before (c).

11. A process comprising:

(a) contacting a quantity of a solid carbonaceous material with a hydrocarbon liquid by employing a sprayer to spray said quantity of solid carbonaceous material with said hydrocarbon liquid, wherein a hydrocarbon liquid to solid carbonaceous material weight ratio in the range of about 1/50 to about 1/500 is employed so as to form a coating of hydrocarbon liquid on said quantity of solid carbonaceous material which serves to minimize absorption of water by the solid carbonaceous material;

(b) collecting excess hydrocarbon liquid resulting from step (a);

(c) passing the thus collected hydrocarbon liquid back to said sprayer;

(d) introducing said quantity of solid carbonaceous material after step (a) to a water containing system; and (e) transferring said quantity of solid carbonaceous material through and from said water containing system to a high pressure vessel.

12. A process as recited in claim 11 further comprising the step of retorting said quantity of solid carbonaceous material in said retort to thereby produce hydrocarbon liquid, followed by passing at least a portion of hydrocarbon liquid so produced to said sprayer for spraying onto said quantity of solid carbonaceous material.

* * * * *